US005727265A

United States Patent [19]

Ziegler et al.

[11] Patent Number: 5,727,265

[45] Date of Patent: Mar. 17, 1998

[54] COLLAPSIBLE PLAYYARD

[76] Inventors: Scott Ziegler, 932 Vista Del Monte Way, El Cajon, Calif. 92020; Kevin Maloney, 78 Wickham Rd., North Kingstown, R.I. 02852

[21] Appl. No.: 608,903

[22] Filed: Feb. 29, 1996

Related U.S. Application Data

[63] Continuation-in-part of Ser. No. 437,631, May 9, 1995, Pat. No. 5,560,055.

[51] Int. Cl.[6] ..... A47D 7/00

[52] U.S. Cl. ..... 5/99.1; 5/93.1

[58] Field of Search ..... 5/99.1, 93.1, 102, 5/101

[56] References Cited

U.S. PATENT DOCUMENTS

| | | | |
|---|---|---|---|
| 2,602,643 | 7/1952 | Caldwell, Jr. | 5/99.1 |
| 2,870,462 | 1/1959 | Turrin et al. | 5/99.1 |
| 3,162,460 | 12/1964 | Davidson | 5/99.1 |
| 3,339,213 | 9/1967 | Spencer | 5/99.1 |
| 3,351,323 | 11/1967 | Spencer | 5/99.1 |
| 3,430,273 | 3/1969 | Stillwaugh | 5/99.1 |
| 3,789,439 | 2/1974 | Berg et al. | 5/99.1 |
| 4,044,411 | 8/1977 | Peterson | 5/99.1 |
| 4,070,716 | 1/1978 | Satt et al. | 5/99.1 |
| 4,202,065 | 5/1980 | Sullivan | 5/99.1 |
| 4,376,318 | 3/1983 | Cirillo | 5/99.1 |
| 4,561,138 | 12/1985 | Hwang | 5/99.1 |
| 4,573,224 | 3/1986 | Saint | 5/99.1 |
| 4,651,367 | 3/1987 | Osher et al. | 5/99.1 |
| 4,688,280 | 8/1987 | Kohus et al. | 5/99.1 |
| 4,692,953 | 9/1987 | Fetters | 5/99.1 |
| 4,765,004 | 8/1988 | Kessel | 5/99.1 |
| 4,811,437 | 3/1989 | Dillner et al. | 5/99.1 |
| 4,837,875 | 6/1989 | Shamie et al. | 5/99.1 |
| 4,934,025 | 6/1990 | Mariol | 5/99.1 |
| 4,985,948 | 1/1991 | Mariol | 5/99.1 |
| 5,197,154 | 3/1993 | Shamie | 5/99.1 |
| 5,228,154 | 7/1993 | Brevi et al. | 5/99.1 |
| 5,239,714 | 8/1993 | Huang | 5/99.1 |
| 5,248,713 | 9/1993 | Shamie | 5/99.1 |
| 5,279,006 | 1/1994 | Teng | 5/99.1 |
| 5,293,656 | 3/1994 | Chan | 5/99.1 |
| 5,339,470 | 8/1994 | Shamie | 5/99.1 |
| 5,353,451 | 10/1994 | Hsiung | 5/99.1 |
| 5,363,521 | 11/1994 | Garland et al. | 5/99.1 |
| 5,381,570 | 1/1995 | Cheng | 5/99.1 |
| 5,394,574 | 3/1995 | Chuang | 5/99.1 |
| 5,454,124 | 10/1995 | Huang | 5/99.1 |
| 5,457,828 | 10/1995 | Huang | 5/99.1 |
| 5,465,439 | 11/1995 | Chien | 5/99.1 |
| 5,485,655 | 1/1996 | Wang | 5/99.1 |

*Primary Examiner*—Steven N. Meyers
*Assistant Examiner*—Tuyet-Phuong Pham
*Attorney, Agent, or Firm*—Kurt R. Benson

[57] ABSTRACT

A collapsible playyard for an infant includes a pair of frame subassemblies and a plurality of collapsible connecting members which normally maintain the frame subassemblies in spaced substantially parallel relation. The frame subassemblies include knuckle joints which cooperate to maintain the frame assembly in an erected position, but at least a portion of which are reoriented as the connecting members are collapsed to allow the frame subassemblies to also be collapsed. The width of one of the frame subassemblies is smaller than the width of the other frame subassembly to allow the two frame subassemblies to be at least partially nested together and then folded in half to form a compact collapsed structure.

9 Claims, 15 Drawing Sheets

COLLAPSIBLE PLAYYARD

BACKGROUND AND SUMMARY OF THE INVENTION

This is a continuation-in-part of application Ser. No. 08/437,631 filed May 9, 1995, now U.S. Pat. No. 5,560,055.

The instant invention relates to infant playyards and more particularly to a playyard for an infant which is quickly and easily movable between a collapsed position and an erected position.

A variety of different playyards have been heretofore available and, in this regard, the playyards disclosed in the U.S. Pat. No. to Peterson, No. 4,044,411; Satt et al., No. 4,070,716; Cirillo, No. 4,376,318; Hwang, No. 4,561,138; Saint, No. 4,573,224; Osher et al., No. 4,651,367; Kohus et al., No. 4,688,280; Fetters, No. 4,692,953; Shamie et al., No. 4,837,875; Mariol, No. 4,985,948; Shamie, No. 5,197,154; Brevi et al., No. 5,228,154; Huang, No. 5,239,714; Shamie, No. 5,243,718; Teng, No. 5,279,006; Cheng, No. 5,381,570; and Chuang, No. 5,394,574, represent the closest prior art to the subject invention of which the Applicant is aware.

It has generally been found that in order to be effective, a playyard must be sufficiently rugged and durable to provide a suitable confining structure for an infant. In addition, however, it has been found that it is highly desirable for a playyard to be readily collapsible to a sufficiently reduced overall size to enable it to be easily transported. However, while the desirability of having a playyard structure which is readily and easily collapsible has generally been heretofore recognized, the prior art, particularly as exemplified by the playyard structures disclosed in the above-referenced U.S. Patents, has failed to provide a playyard which is quickly and easily collapsible with a minimum of manipulative operations. Hence, a need exists for an effective and durable playyard for an infant which is effectively adapted to be moved between collapsed and erected positions with a minimum of simple manipulative operations.

The instant invention provides a highly effective playyard and subassembly therefore which are adapted to enable the playyard to be moved between collapsed and erected positions with a minimum of manipulative operations. Specifically, a first embodiment of the playyard of the instant invention comprises a frame subassembly comprising a plurality of collapsible frame elements which are connected so that when the subassembly is in an erected position, the frame elements essentially work against one another to prevent the subassembly from being inadvertently collapsed, but so that when one of the frame elements is manually moved to a collapsed position, at least one adjacent frame element connected thereto is automatically moved to a readily collapsible position. Still more specifically, the frame subassembly of the instant invention comprises at least two, and preferably three, collapsible frame elements which are connected so that when one of the frame elements is collapsed by pivoting a pair of frame sections thereof about a center knuckle joint, one or more adjacent frame elements connected thereto are at least partially rotated to reorient knuckle joints therein so that they can be readily and easily collapsed. In this regard, because the frame subassembly is constructed so that certain of the frame elements thereof are reoriented to collapsible positions when other frame elements are moved to collapsed positions, the subassembly can be retained in an erected position with a minimum of locking mechanisms so that only a minimum number of unlocking operations is required to move the subassembly to a fully collapsed position.

Still more specifically, the collapsible frame subassembly of the first embodiment of the instant invention in its most basic format comprises first and second frame members which are connected together in substantially perpendicular relation. The first and second frame members each include a pair of frame member sections which are joined by a knuckle joint, and the knuckle joints each only permit relative pivotal movement between the respective frame member sections thereof in a single direction. The directions of pivotal movement permitted by the knuckle joints of the first and second frame members are oriented at an angle of at least approximately 90 degrees when the subassembly is in an erected position. The second frame member is, however, attached to the first frame member such that relative pivoting between the second frame member sections thereof to substantially side-by-side positions causes the knuckle joint of the first frame member to be reoriented by approximately 90 degrees to permit the first frame member to be collapsed in a corresponding predetermined direction.

The collapsible subassembly of the first embodiment of the playyard preferably includes first, second and third frame members which are connected together so that they are positionable in an erected position in which the first and third frame members are disposed and spaced in substantially parallel coplanar relation and in which the first and second frame members cooperate with the second frame member to define a generally square-cornered U-shaped structure. The frame members each include a pair of frame member sections which are pivotally joined together by a knuckle joint, and the frame members are constructed so that the frame member sections thereof are in aligned relation when the frame member sections are in erected positions. The knuckle joints are adapted so that they only permit relative pivotal movement between the frame member sections thereof in a single direction from aligned relation, and the first and third frame members are oriented so that when the subassembly is in the erected position thereof, the knuckle joints of the first and third frame members only permit pivoting between the respective frame member sections thereof in directions which are angularly related by an angle of at least approximately 90 degrees. Further, the second frame member is connected to the first and third frame members such that relative pivoting between the second frame member sections to substantially parallel side-by-side positions causes sufficient angular rotation of the knuckle joint of at least one of the first and third frame members to permit relative pivoting between the frame member sections of the first and third members in substantially the same direction for collapsing the subassembly. The collapsible subassembly preferably further comprises means for releasably maintaining the second frame member in the erected position thereof, and the first and third frame members are preferably retained in the erected positions thereof by the relative positions of the knuckle joints thereof when the subassembly is in the erected position. The subassembly is preferably adapted to be included as part of the frame assembly of a collapsible playyard wherein covering means is provided on the frame assembly. Further, the covering means preferably functions to help prevent pivoting of the knuckle joint of at least one of the first and third frame members when the subassembly is in the erected position thereof, but not when the second frame member is in a collapsed position. Accordingly, the covering means on the playyard preferably cooperates with the frame subassembly for retaining the frame assembly in an erected position in a manner which nevertheless allows the frame assembly to be readily and easily collapsed.

It has been found that the first embodiment of the frame assembly of the instant invention provides a highly effective and readily collapsible frame for a playyard for an infant. In this regard, by utilizing frame members which essentially work against each other to retain the playyard in an erected position but which are automatically reoriented to collapsible positions as an adjacent frame member is collapsed, the playyard of the instant invention can be effectively retained in an erected position with a minimum of locking or latching elements. As a result, it can be automatically moved to a collapsed position with a minimum of unlocking or unlatching manipulations.

A second embodiment of the collapsible frame assembly of the instant invention comprises first and second frame subassemblies and a plurality of collapsible connecting members which are operative for connecting the first and second frame subassemblies so that the frame assembly is movable between an erected position in which the frame subassemblies are in spaced substantially parallel relation and a partially collapsed position in which the frame subassemblies are received in an at least partially nested relation. Each of the frame subassemblies includes connected first, second, third and fourth frame members which cooperate to define a generally rectangular frame structure, and the width of the first frame subassembly is slightly smaller than the width of the second frame subassembly so as to permit the first frame subassembly to be received in an at least partially nested relation within the second frame subassembly when the connecting members are in a collapsed position. The first subassembly preferably defines an upper or top subassembly of the frame assembly, and the second subassembly preferably defines a lower or bottom subassembly thereof. Further, the first and third frame members of each of the first and second frame subassemblies each include a pair of frame member sections which are hingeably connected by means of a knuckle joint. When the frame assembly is in an erected position, the knuckle joints of the first frame subassembly are positioned so that the frame member sections thereof are only pivotable in a direction which is angularly oriented at approximately 90 degrees to the direction in which the corresponding frame member sections of the second frame subassembly are pivotable by means of the knuckle joints thereof. Accordingly, when the frame assembly is in an erected position, the knuckle joints of the first and second frame subassemblies cooperate to resist collapsing of the overall frame assembly. However, the collapsible connecting members which are operative for maintaining the first and second frame subassemblies in spaced relation are adapted so that as they are moved toward collapsed positions, they function to rotate the knuckle joints of at least one of either the first frame subassembly or the second frame subassembly in order to position all of the knuckle joints so that they are pivotable in the same direction for folding the frame assembly when the first frame subassembly is received in nested relation in the second frame subassembly. Accordingly, the knuckle joints of the first and second frame subassemblies cooperate to retain the first and second frame subassemblies in erected positions, but when the connecting members are collapsed, the knuckle joints of one of the subassemblies are reoriented to allow the playyard to be folded into a compact collapsed structure.

Accordingly, it is seen that the second embodiment of the instant invention provides an effective frame structure for a playyard which is also adapted to be readily and easily erected and collapsed. Further, because the first frame subassembly of the playyard is adapted to be received in an at least partially nested relation in the second subassembly, the second embodiment of the instant invention can be effectively utilized to provide a relatively simple lightweight playyard frame structure which can be easily collapsed and transported.

Accordingly, it is a primary object of the instant invention to provide an effective playyard for an infant which is adapted to be moved between erected and collapsed positions with a minimum of manipulations.

Another object of the instant invention is to provide a readily collapsible playyard assembly which is operative with a minimum of locking or latching elements for retaining it in an erected position.

An even still further object of the instant invention is to provide an effective subassembly for a playyard wherein certain frame members of the subassembly are automatically moved to collapsible positions once adjacent frame members have been collapsed.

A still further object of the instant invention is to provide an effective collapsible frame assembly for a playyard which is adapted to be embodied in a relatively lightweight construction.

A still further object of the instant invention is to provide a frame assembly for a playyard which is adapted to be effectively and easily collapsed to a relatively compact lightweight structure which is readily transportable.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
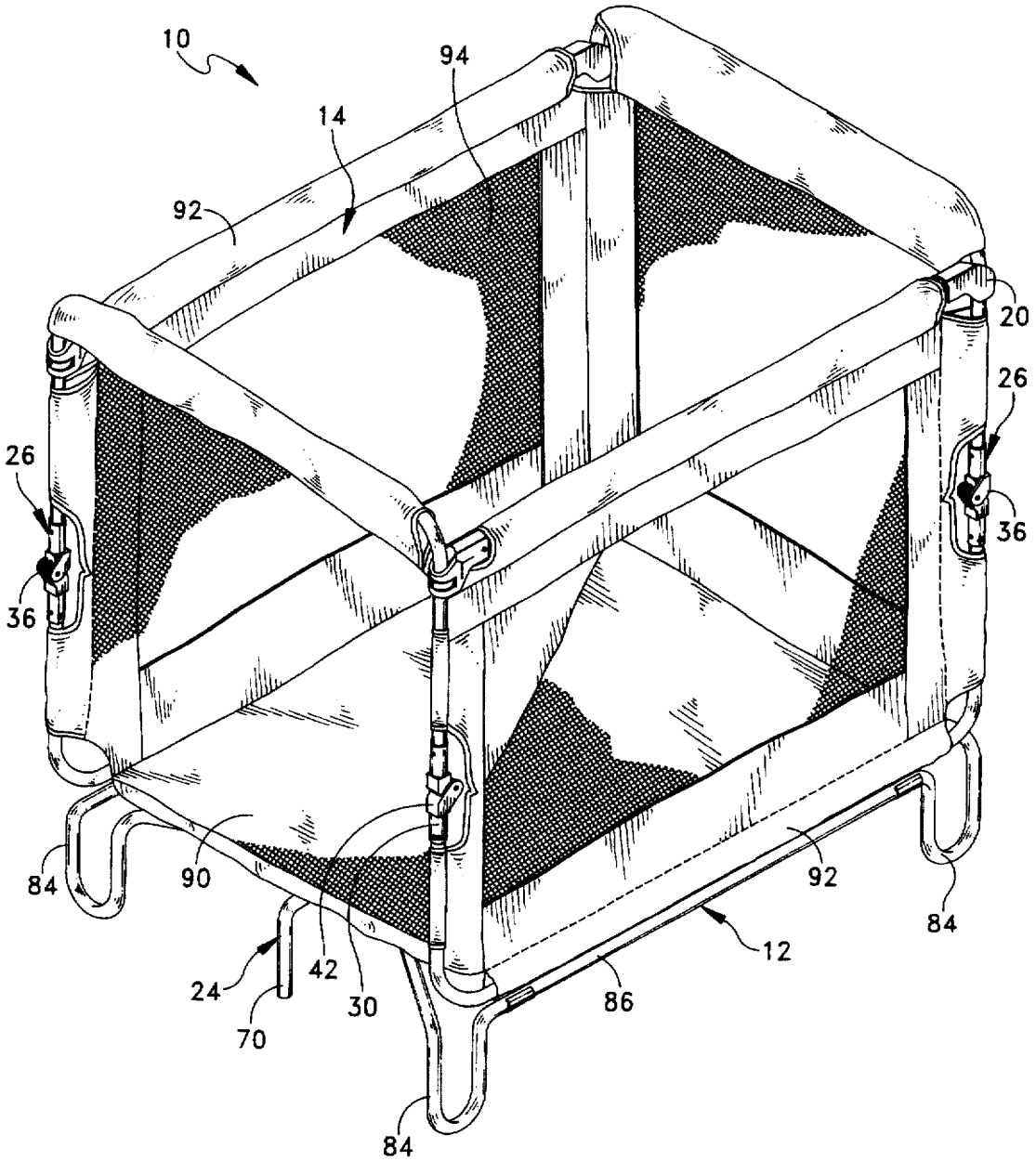
FIG. 1 is a perspective view of a first embodiment of the playyard of the instant invention in an erected position.

Referring now to the drawings, a first embodiment of the playyard of the instant invention is illustrated in FIGS. 1–16 and generally indicated at 10 in FIGS. 1, 12 and 14–16. The playyard 10 includes a frame assembly generally indicated at 12 and a fabric covering generally indicated at 14 which cooperates with the frame assembly 12 for defining a collapsible playyard assembly which is movable between the erected position illustrated in FIG. 1 and the collapsed position illustrated in FIG. 16. As illustrated in FIG. 1, when the playyard 10 is in the erected position thereof, the frame assembly 12 provides a supporting structure for retaining the covering 14 in a position in which it cooperates with the frame assembly 12 for defining an enclosed playyard structure for receiving and confining an infant therein.

Figure 2:
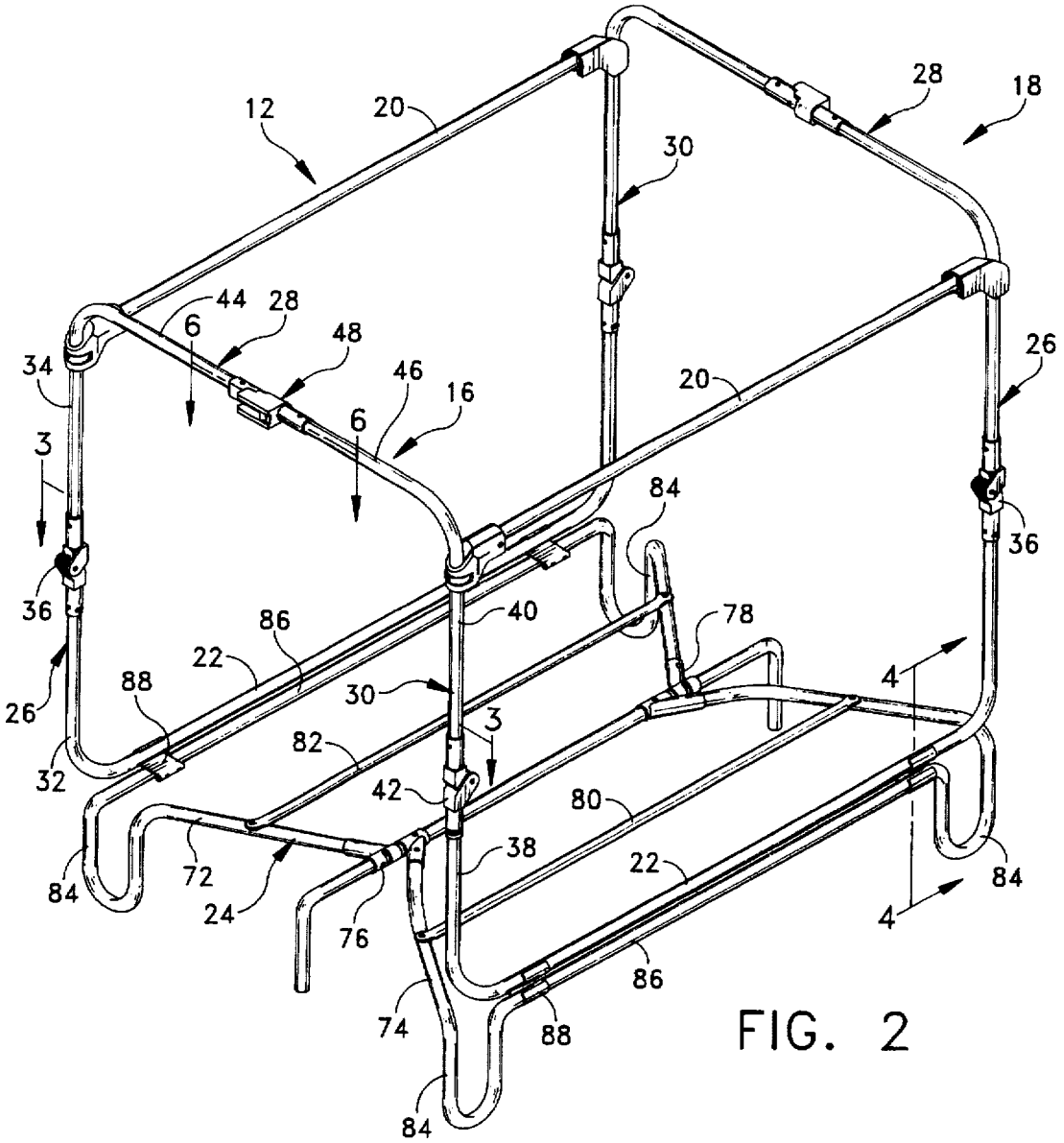
FIG. 2 is a perspective view of the frame assembly thereof in an erected position.
Figure 3:
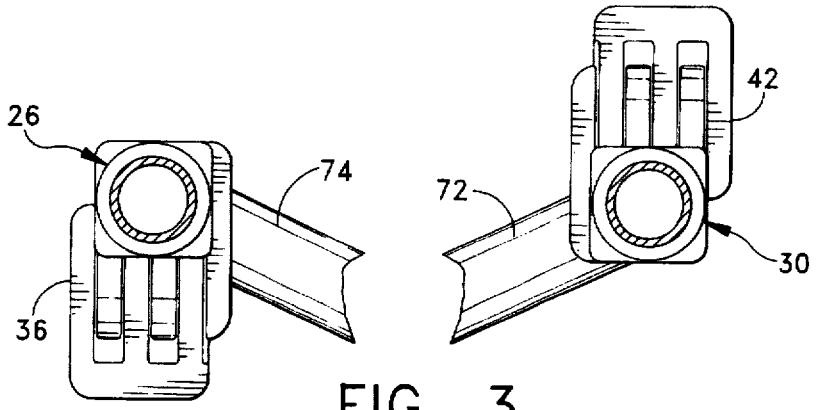
FIG. 3 is a sectional view taken along line 3—3 in FIG. 2.

Referring to FIG. 2, the frame assembly 12 is more clearly illustrated. The frame assembly 12 is adapted so that the various components thereof cooperate to retain the playyard in the erected position thereof in a manner which allows the playyard 10 to be readily and easily moved to the collapsed position thereof which a minimum of manipulations. In this regard, the frame assembly 12 includes first and second end subassemblies 16 and 18 which are connected by upper and lower side frame elements 20 and 22 and a floor assembly generally indicated at 24. The subassemblies 16 and 18 are adapted so that the various components thereof cooperate to maintain the subassemblies 16 and 18 in erected positions, but so that they can be read fly moved to collapsed positions with a single unlocking or unlatching manipulation as will hereinafter be more fully set forth.

Figure 10:
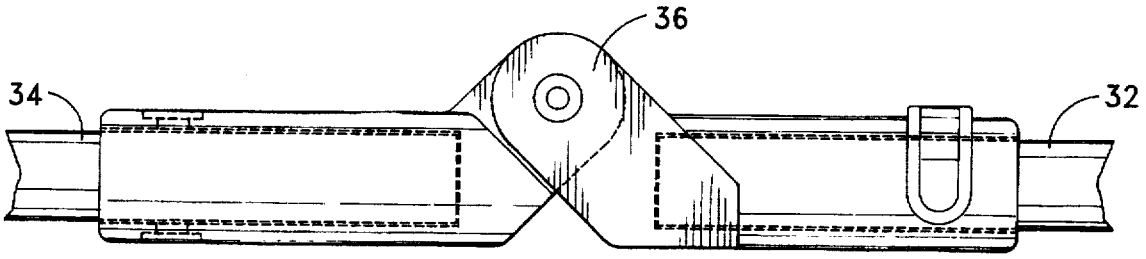
FIG. 10 is a side elevational view of the knuckle assembly of one of the vertical frame members in an erected position.
Figure 11:
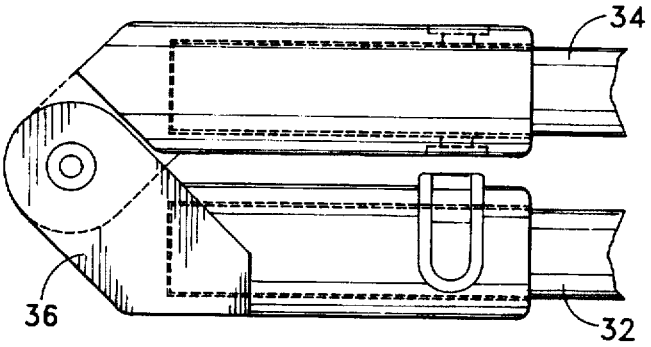
FIG. 11 is a side elevational view thereof in a collapsed position.
Figure 12:
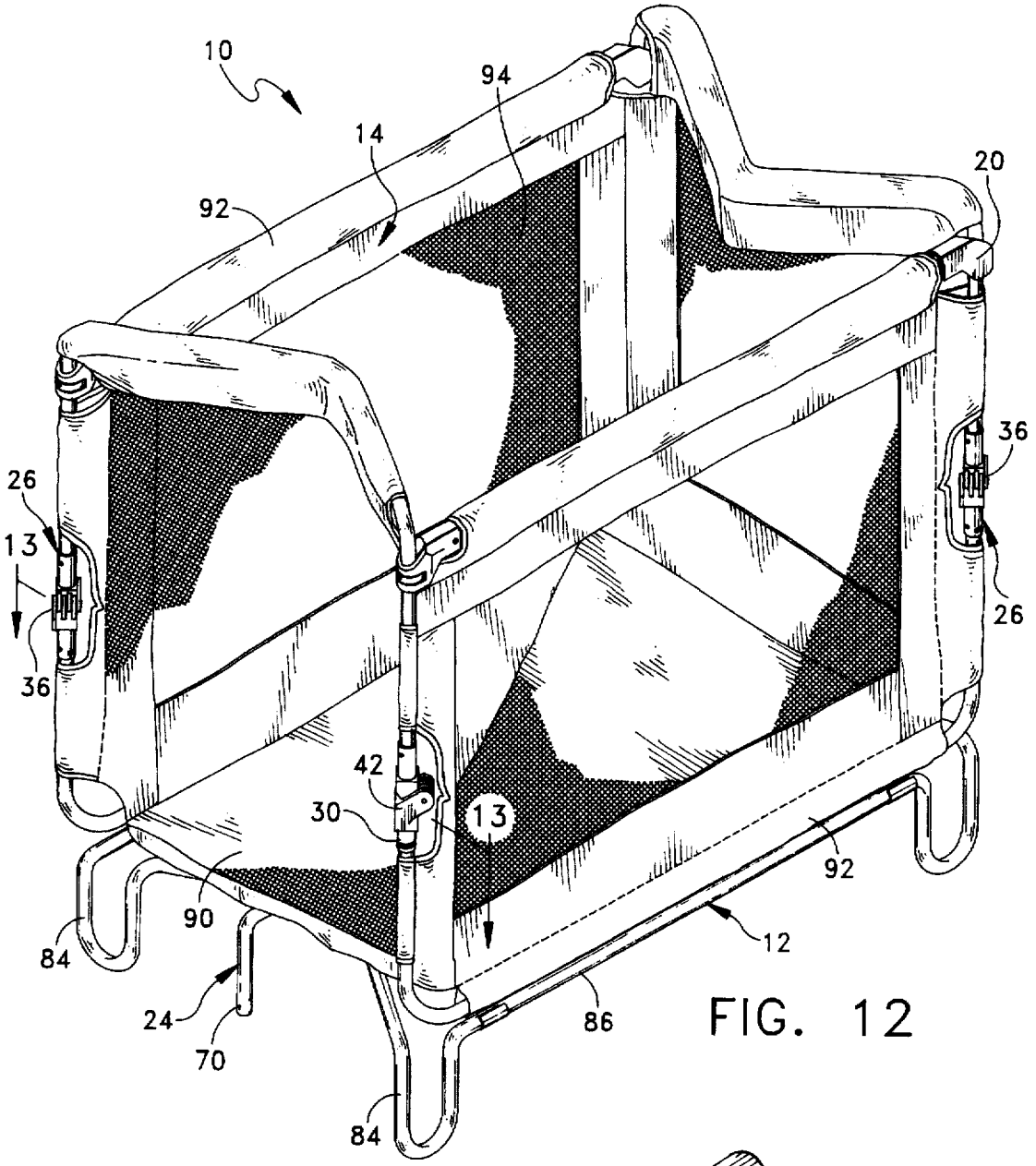
FIG. 12 is a perspective view of the playyard in a partially collapsed position.
Figure 13:
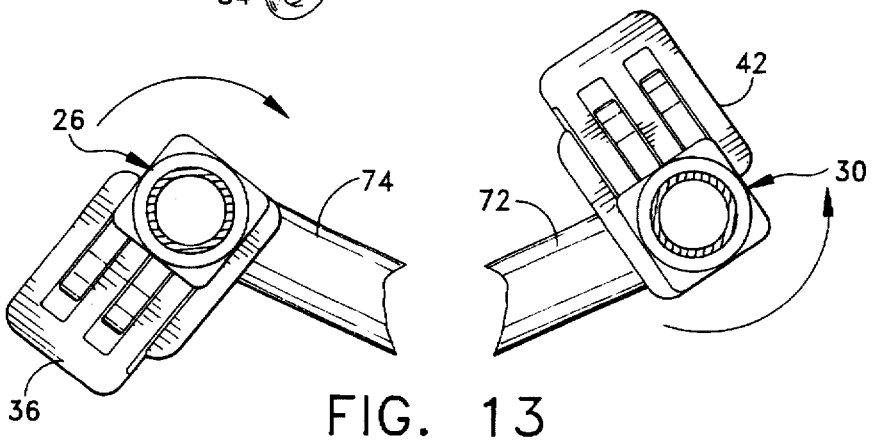
FIG. 13 is a sectional view taken along line 13—13 in FIG. 12.
Figure 14:
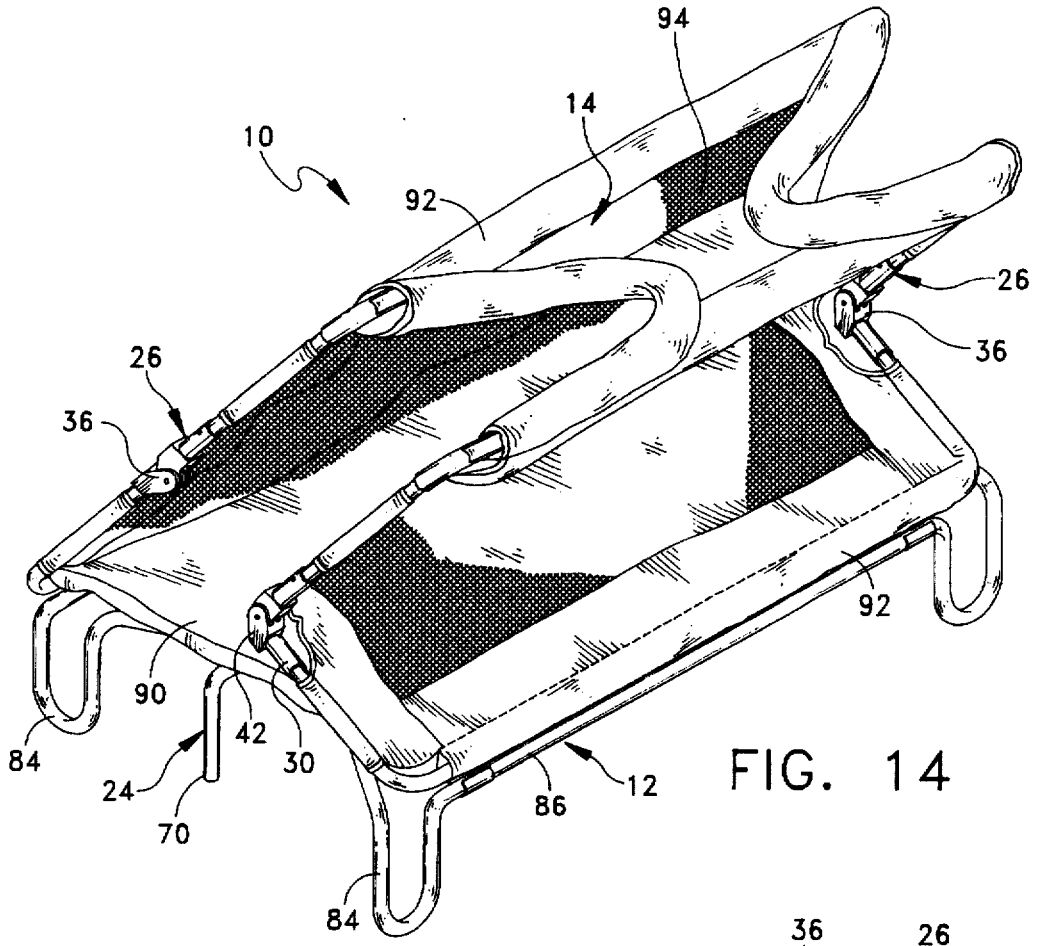
FIGS. 14–16 are sequential perspective views of the first embodiment of the playyard as it is moved to a fully collapsed position.
Figure 15:
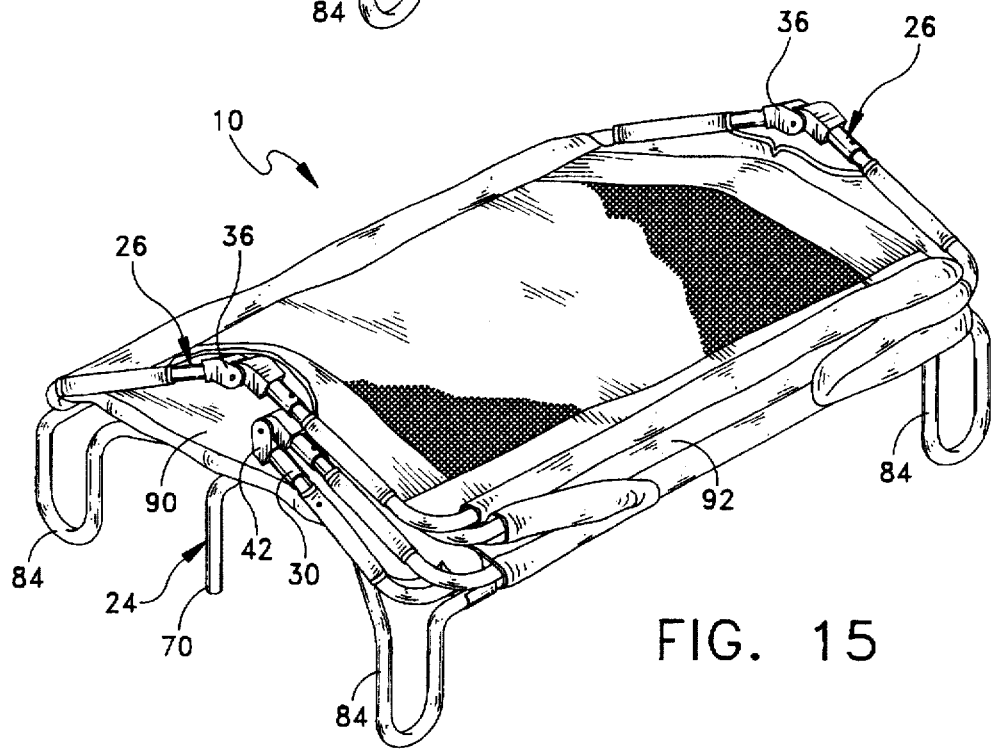

The frame subassemblies 16 and 18 each include first, second and third frame members 26, 28 and 30, respectively. Each of the first frame members 26 includes lower and upper first frame member sections 32 and 34 which are pivotally joined by a knuckle joint 36, and each of the third frame members 30 includes lower and upper frame member sections 38 and 40 which are joined by a knuckle joint 42. Each of the second frame members 28 includes a pair of second frame member sections 44 and 46 which are joined by a knuckle joint 48. The knuckle joints 36 and 42 are of substantially identical configuration and they are rotatably joined to their respective frame member sections 32 and 38 and nonrotatably joined to their respective frame member sections 34 and 40. As illustrated in FIG. 10, the knuckle joints 36 and the correspondingly formed knuckle joints 42 are adapted for connecting the respective frame member sections thereof in substantially aligned relation. However, when the respective frame member sections 32, 34, 38, and 40 of the knuckle joints 36 and 42 are in substantially aligned relation, the knuckle joints 36 and 42 each only permit pivotal movement in a single direction. Further, as illustrated in FIG. 2, the knuckle joints 36 and 42 are constructed and oriented so that when the frame assembly 12 is in the erected position thereof, the knuckle joints 36 and 42 of each subassembly 16 and 18 only permit pivoting between the respective frame member sections thereof in substantially parallel opposite directions. However, as illustrated in FIGS. 12–16, the knuckle joints 36 and 42 are automatically reoriented as the frame members 28 are moved to collapsed positions to enable the frame member sections of the first and third frame members 26 and 30 of each frame subassembly 16 and 18 to be pivoted in substantially the same direction as most clearly illustrated in FIGS. 15 and 16. The frame member sections 44 and 46 of the second frame members 28 are preferably integrally joined in substantially perpendicular relation to the respective adjacent frame member sections 34 and 40 of the respective first and second frame members 26 and 30 thereof. The knuckle joints 48 are also adapted so that when the respective frame member sections 44 and 46 thereof are in substantially aligned relation, they can each only be pivoted in a single direction for moving the second frame members 28 to collapsed positions in which the frame member sections 44 and 46 thereof are in substantially parallel side-by-side relation. The knuckle joints 48 do, however, include locking or latching mechanisms for releasably securing the frame member sections 44 and 46 thereof in substantially aligned relation.

Figure 6:
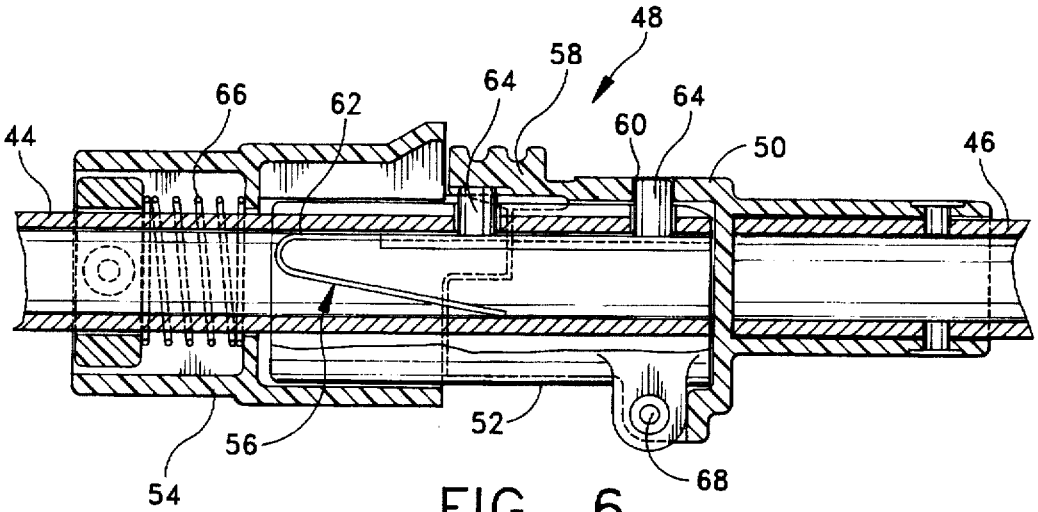
FIG. 6 is a sectional view taken along line 6—6 in FIG. 2.
Figure 7:
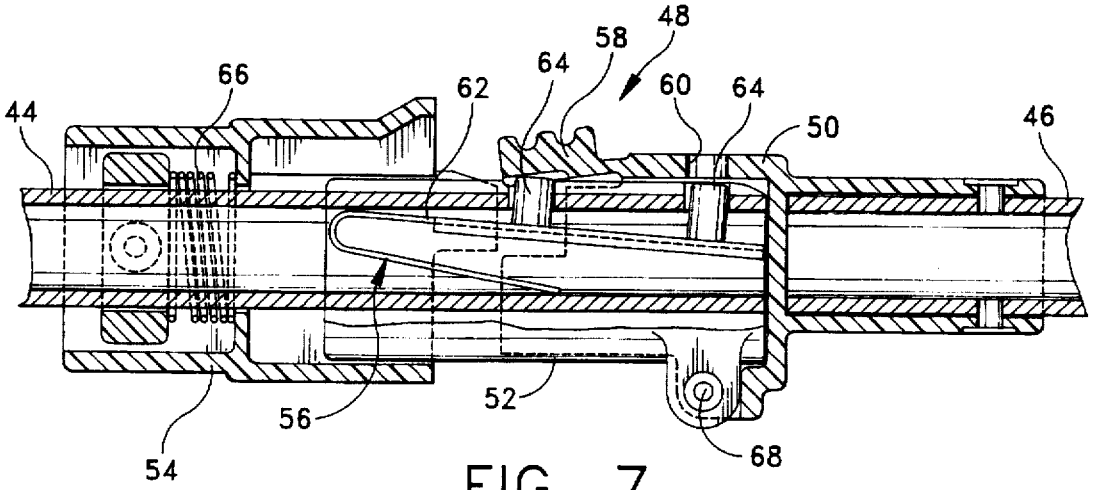
FIG. 7 is a similar view with the latching mechanism in a disengaged position.
Figure 8:
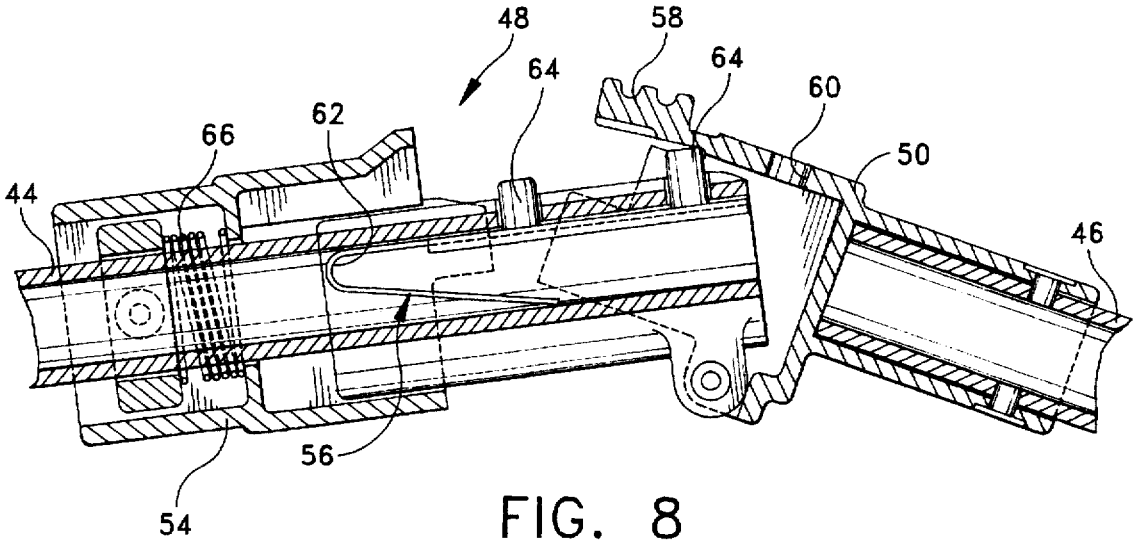
FIG. 8 is a similar sectional view with the knuckle joint in a partially pivoted position.
Figure 9:
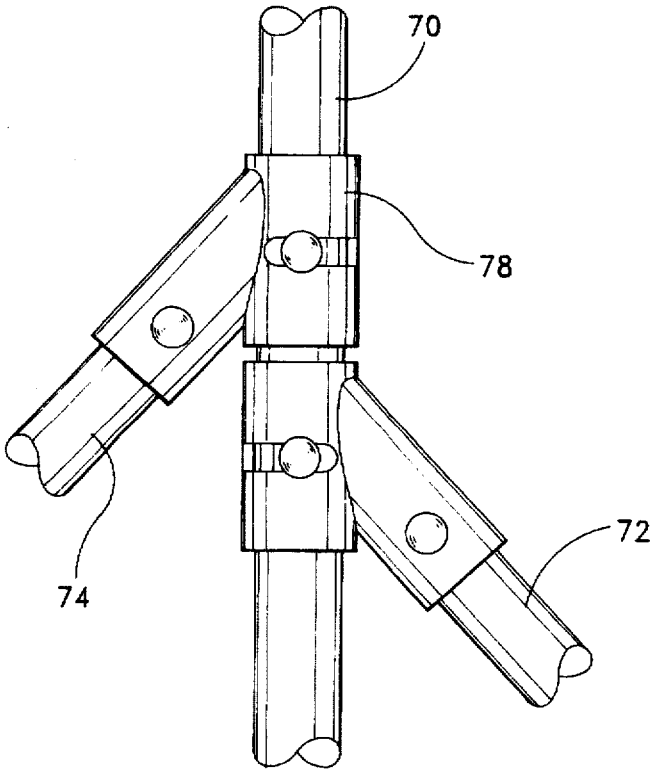
FIG. 9 is a fragmentary top plan view of one end of the center leg section of the bottom frame of the first embodiment of the playyard.

As illustrated in FIGS. 6–8, each of the knuckle joints 48 includes a first or outer latch portion 50 which is attached to the respective frame member section 46 thereof, a second or inner latch portion 52 which is attached to the respective frame member section 44 thereof, a sleeve assembly 54, and an inner spring assembly 56. Each of the outer latch member portions 50 includes a resilient latch button section 58 and each has a latch aperture 60 formed therein. Each of the spring assemblies 56 includes a spring element 62 having a pair of latch pins 64 thereon. As illustrated in FIGS. 6–8, when one of the knuckle joint assemblies 48 is in the latched position thereof illustrated in FIG. 6, the button 58 thereof is depressible to move one of the latch pins 64 thereof inwardly so that the other latch pin 64 thereof is withdrawn from the aperture 60 thereof. The sleeve 54 thereof can then be moved against the force of an internal spring 66 to allow the outer first latch portion 50 thereof to be pivoted about a pivot axis 68 relative to the inner latch portion 52 thereof for pivoting the respective frame member sections 44 and 46 thereof.

As illustrated in FIGS. 2, 12 and 14–16, each of the knuckle joint assemblies 48 is oriented so that when the latching components thereof are disengaged, the respective frame member sections 44 and 46 thereof can be pivoted inwardly in a generally horizontal plane. This causes the adjacent frame member sections 34 and 40 and the respective knuckle joints 36 and 42 attached thereto to be rotated by approximately 90 degrees about substantially vertical axes until the knuckle joints 36 and 42 are reoriented to enable the respective frame member sections thereof to be pivoted in substantially the same direction for collapsing the frame 12.

The side frame members 20 are rotatably attached to the frame subassemblies 16 and 18 adjacent the upper ends of the respective first and third frame members 26 and 30 thereof as illustrated most dearly in FIG. 2. On the other hand, the lower side frame members 22 are integrally attached in substantially perpendicular relation to the lower side frame member sections 32 and 38. Accordingly, the upper and lower side frame members 20 and 22 cooperate to maintain the frame subassemblies 16 and 18 in substantially parallel spaced relation while nevertheless permitting the various components thereof to be rotated or pivoted to move the frame assembly 12 to a collapsed position. The upper and lower side frame members 20 and 22 on one side of the playyard 10 are preferably slightly shorter than the upper and lower side frame members 20 and 22 on the opposite side of the playyard 10 so that one side of the playyard 10 is actually slightly shorter than the other side. This allows the first and third frame members 26 and 30 on the shorter side of the playyard 10 to be more effectively nested with the first and third frame members 26 and 30 on the longer side when the playyard 10 is moved to the collapsed position thereof.

Figure 4:
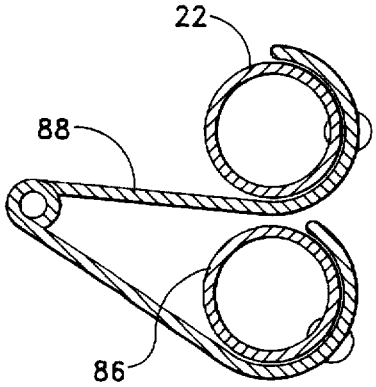
FIG. 4 is a sectional view taken along line 4—4 in FIG. 2.
Figure 5:
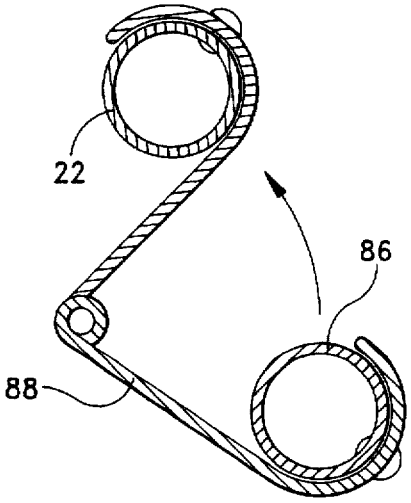
FIG. 5 is a similar view with the first embodiment of the playyard in a collapsed position.

The floor assembly 24 comprises a center leg section 70, a pair of side leg sections 72 and 74, a pair of joint assemblies 76 and 78, and a pair of cross members 80 and 82. The center leg section 70 includes an elongated main center portion and a pair of downwardly turned end leg portions as illustrated in FIG. 2. The side leg sections 72 and 74 extend outwardly from the center leg section 70 and they each include a pair of U-shaped foot portions 84 and an elongated side portion 86. The side portions 86 are secured to the side frame members 22 with pivot joint assemblies 88 which are illustrated in FIGS. 4 and 5. The pivot joint assemblies 88 permit the side portions 72 and 74 to he pivoted relative to the side frame members 22 for moving the center leg sections 70 upwardly to a collapsed position as the frame assembly 12 is collapsed in the manner illustrated in FIGS. 14–16. The joint assemblies 76 and 78 secure the side leg sections 72 and 74 to the center leg section 70 in a manner which allows the side leg sections 72 and 74 to be pivoted relative to the center leg sections 70 as the floor assembly 24 is moved to a collapsed position.

The covering 14 comprises a reinforced fabric floor section 90, a plurality of connected tubular fabric sections 92 which are received over various components of the frame assembly 12, and a plurality of fabric mesh wall sections 94 which cooperate with the floor section 90 and the tubular section 92 to define a collapsible fabric covering for the playyard 10. The various fabric sections, including the floor section 90 and the tubular sections 92, are preferably padded to provide protective cushioning for a child received in the playyard 10.

Figure 16:
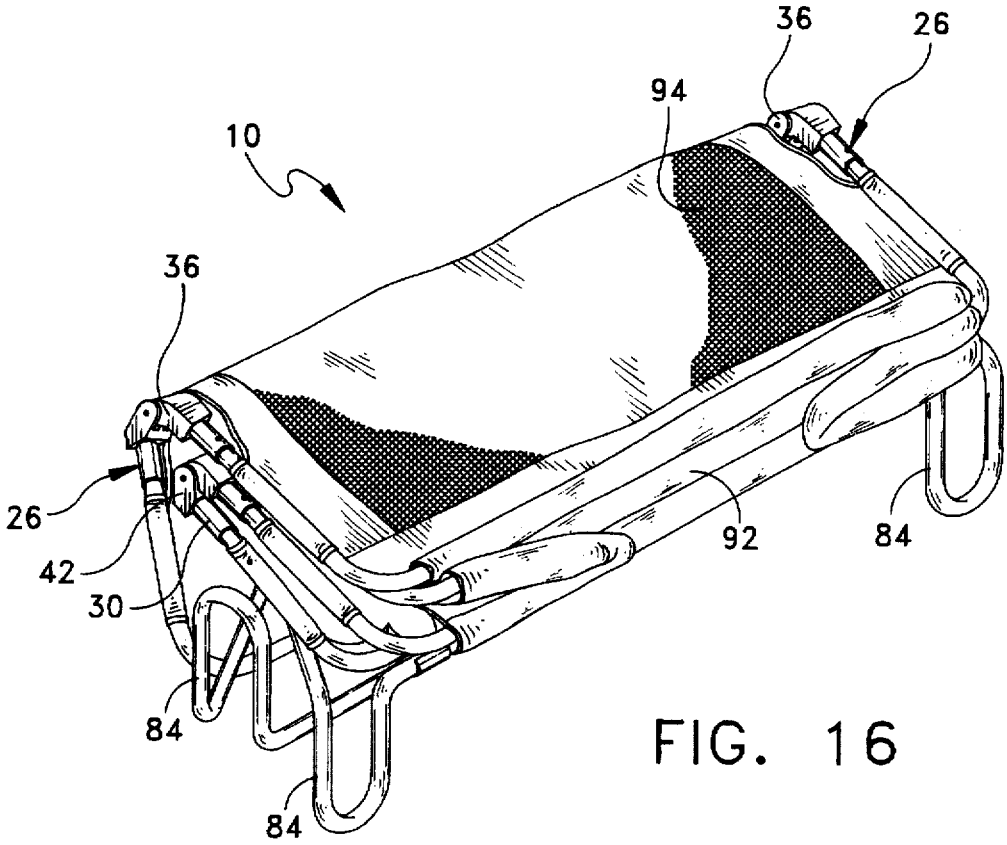
Figure 17:
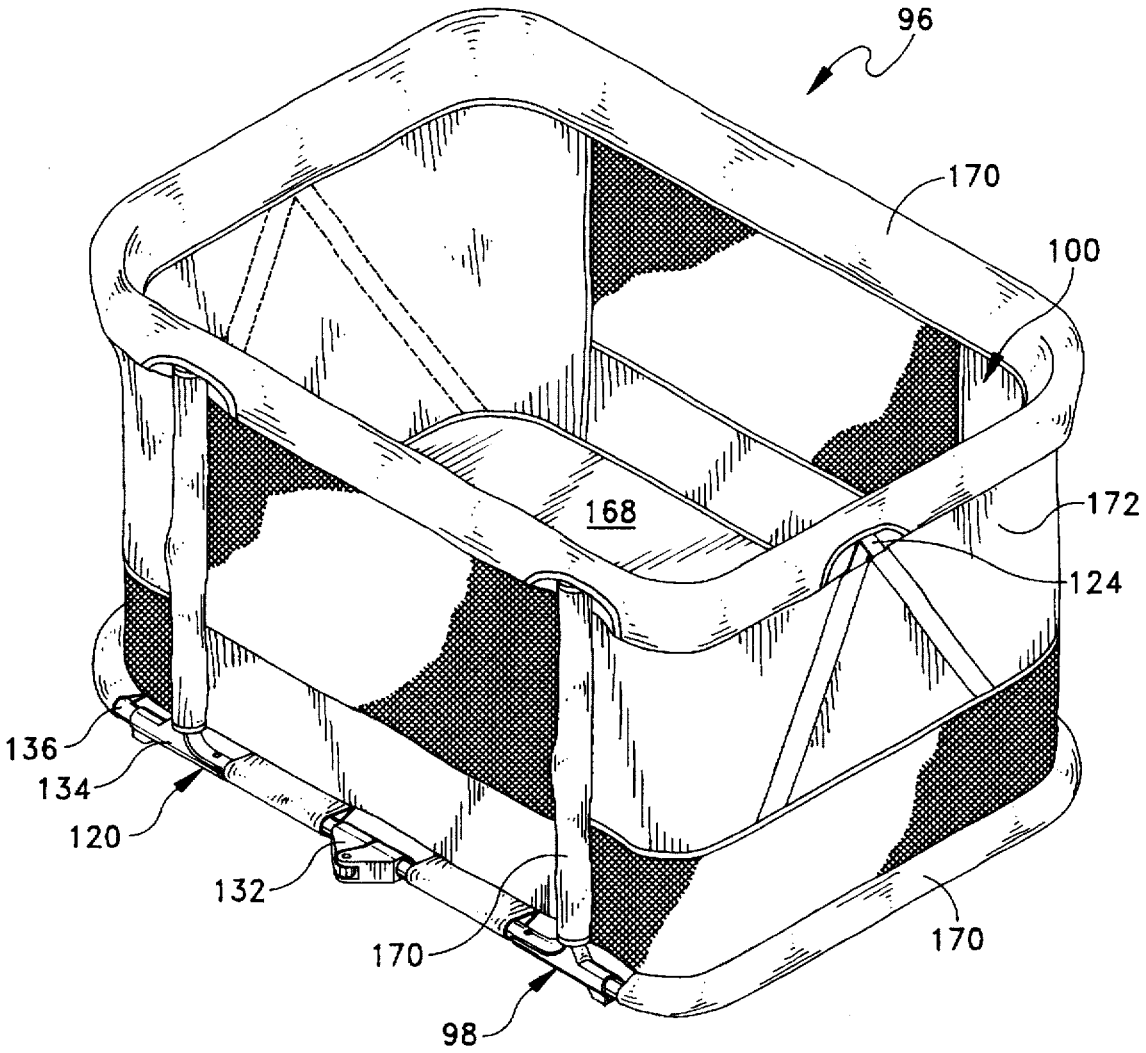
FIG. 17 is a perspective view of a second embodiment of the playyard and frame assembly of the instant invention.

Referring to FIGS. 1, 2, 6–8, 12 and 14–16, it will be seen that the playyard 10 is adapted to be readily and easily moved between the fully erected position illustrated in FIG. 1 and the fully collapsed position illustrated in FIG. 16. In this regard, when the playyard 10 is in the fully erected position thereof, the knuckle joints 48 maintain the second frame member sections 44 and 46 in aligned relation and they also maintain the first and third frame member sections of the subassemblies 16 and 18 in positions where the knuckle joints 36 and 42 thereof are only pivotable in opposite directions. Further, the fabric covering 14 on the frame assembly 12 resists pivoting of either of the knuckle joints 42 or 36 in outward directions. As a result, the relative positions of the knuckle joints 42 and 36 when the said assemblies 16 and 18 are in the erected positions thereof and the fabric covering 14 effectively cooperate to maintain the playyard 10 in an erected position. However, the playyard 10 can be easily moved to a collapsed position simply by disengaging the latching components of the knuckle joints 48 in the manner hereinabove set forth to allow the adjacent frame member sections 44 and 46 of the subassemblies 16 and 18 to be pivoted inwardly and together until the adjacent frame member sections 44 and 46 are received in substantially parallel side-by-side positions. As the knuckle joints 48 are pivoted inwardly in this manner, the center leg section 70 of the floor assembly 24 is moved upwardly to collapse the floor assembly 24 until the first and third frame members 26 and 30 of the subassemblies 16 and 18 are in closely adjacent relation. Further, as the second frame members 28 are collapsed by pivoting the knuckle joints 48 thereof inwardly, the knuckle joints 36 and 42 of each subassembly 16 and 18 are automatically rotated in opposite directions until they are reoriented so that all of the first and third frame members 26 and 30 can be moved to the fully collapsed positions thereof by pivoting the frame member sections 34 and 40 in essentially the same direction towards one side of the playyard 10 as illustrated in FIG. 16. Thereafter, the playyard 10 can be automatically moved to the erected position thereof by simply lifting up on one of the upper side frame members 20 causing the first and third frame member sections 26 and 30 to be moved to erected positions and simultaneously causing the second frame members 28 to be moved to erected positions. As this occurs, the floor assembly 24 is also moved to the fully erected position thereof illustrated in FIG. 2, and, by pushing the knuckle joints 40 outwardly, the playyard 10 can be locked in the fully erected position thereof.

It is seen, therefore, that the first embodiment of the instant invention provides a highly effective playyard. The playyard 10 can be moved to a collapsed position simply by manipulating the knuckle joints 48 to disengage the latching assemblies contained therein and then folding the various components of the playyard inwardly and downwardly. As a result, the playyard 10 can be collapsed to the position illustrated in FIG. 16 within a relatively few seconds. The playyard 10 can also be erected within a matter of a few seconds with a simple and easy lifting movement of one of the side frame members 20. Further, it will be understood that the basic concept of providing a playyard having a frame subassembly which is constructed so that collapsing one frame member reorients another adjacent frame member can also be embodied in a variety of other playyard constructions, such as one in which collapsing a vertical frame member automatically reorients an adjacent horizontal frame member to a collapsible position. Hence, it is seen that the playyard 10 represents a significant advancement in the art which has substantial commercial merit.

Referring now to FIGS. 17–27, a second embodiment of the playyard of the instant invention is illustrated and generally indicated at 96. The playyard 96 comprises a frame assembly generally indicated at 98 and a fabric covering generally indicated at 100. The frame assembly 98 is adapted for supporting the fabric covering 100 in the manner illustrated in FIG. 7 so as to provide an effective enclosed area in the playyard 96 for safely confining an infant. The frame assembly 98 includes an upper or first frame subassembly 102 and a lower or second frame subassembly 104 which are connected by means of a plurality of collapsible connecting members 106. As illustrated most clearly in FIGS. 26 and 27, the width of the first frame subassembly 102 is slightly smaller than the width of the second frame subassembly 104 to allow the first frame subassembly 102 to be received in the at least partially nested position illustrated in FIG. 26.

The first frame subassembly 102 comprises first, second, third and fourth connected frame members 108, 110, 112 and 114, respectively, which cooperate to define a generally rectangular subframe structure. As illustrated, each of the first and third frame members 108 and 112 comprises a pair of frame member sections 116 which are hingeably connected by means of a knuckle joint 118. Each of the knuckle joints 118 is adapted to permit hinging or pivoting of the frame member sections 116 thereof in a single direction which, when the frame assembly 98 is in an erected position, falls in a generally vertical plane with the frame member sections 116 being pivotable upwardly relative to their respective knuckle joints 118. The first and third frame members 108 and 112 cooperate to define the width of the first frame subassembly 102, and they are integrally joined to the second and fourth frame members 110 and 114 at the corners of the first frame subassembly 102 as illustrated.

Figure 18:
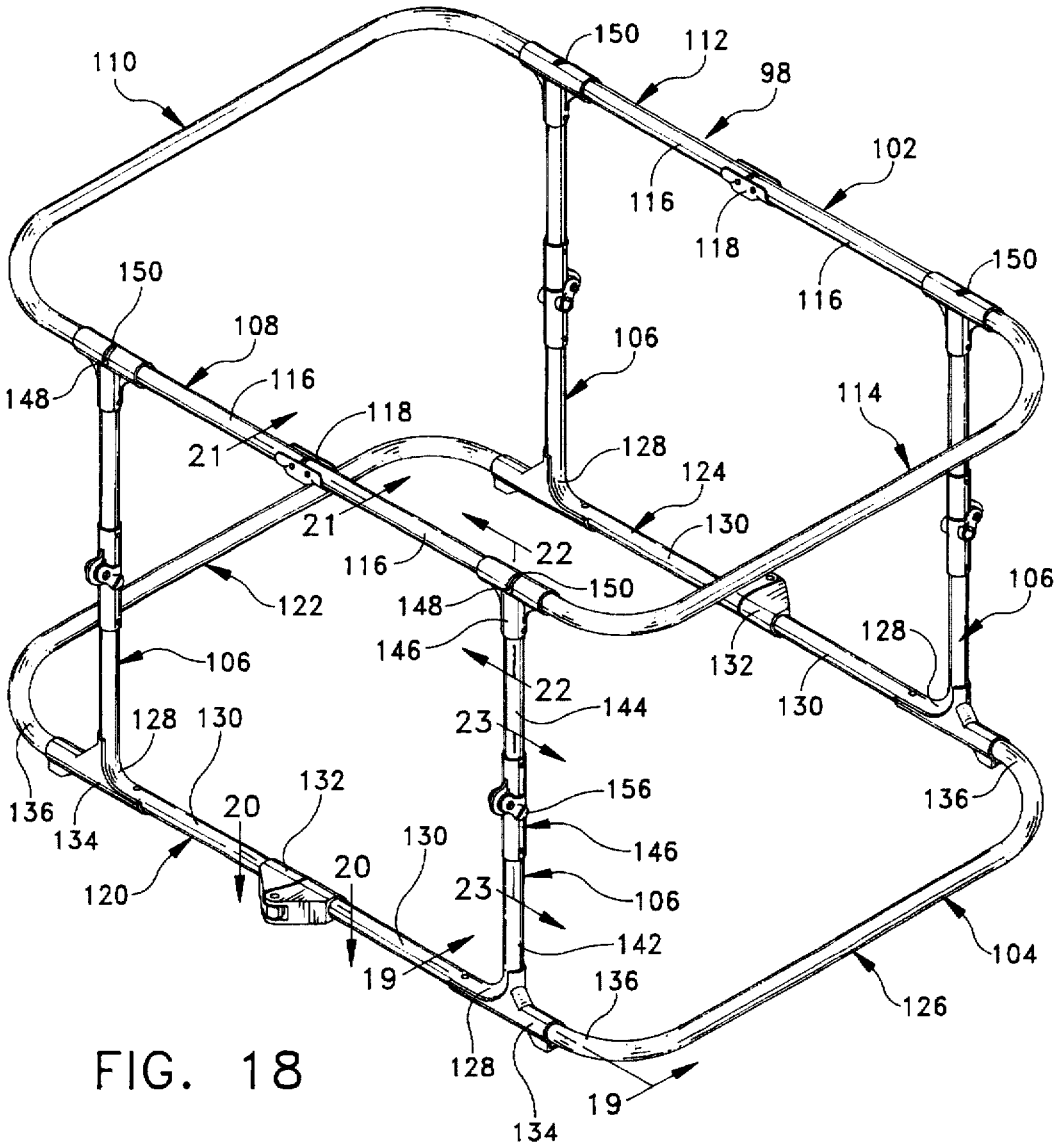
FIG. 18 is a perspective view of the frame assembly thereof per se.
Figure 19:
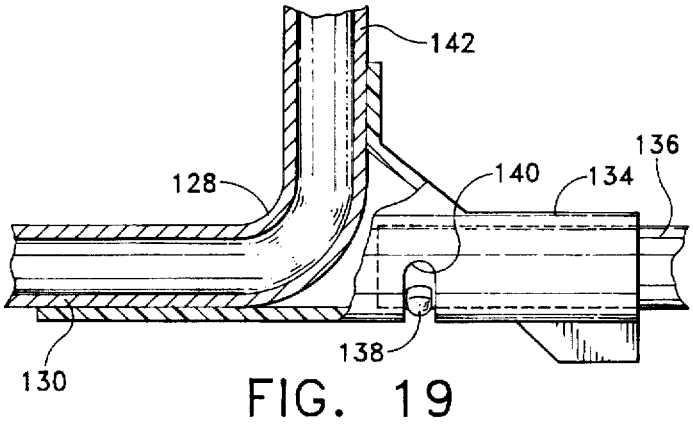
FIG. 19 is a sectional view taken along line 19—19 in FIG. 18.
Figure 20:
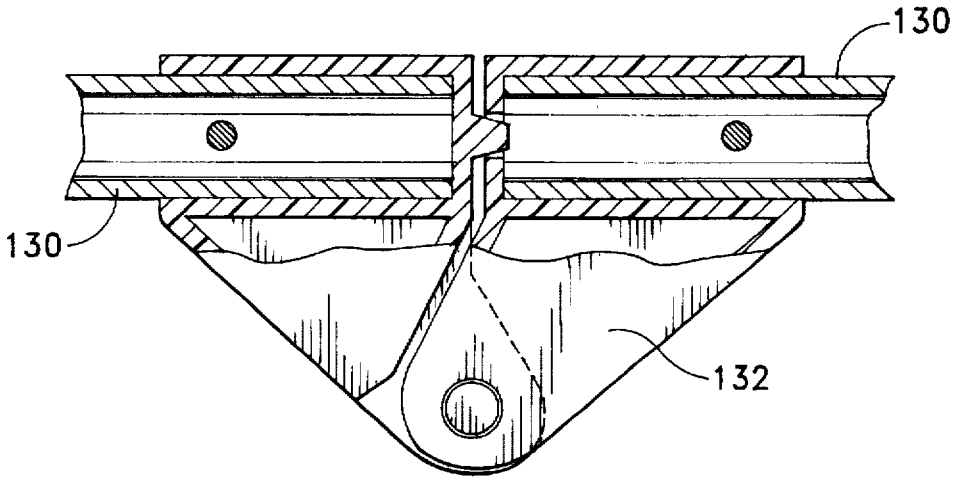
FIG. 20 is a sectional view taken along line 20—20 in FIG. 18.
Figure 20A:
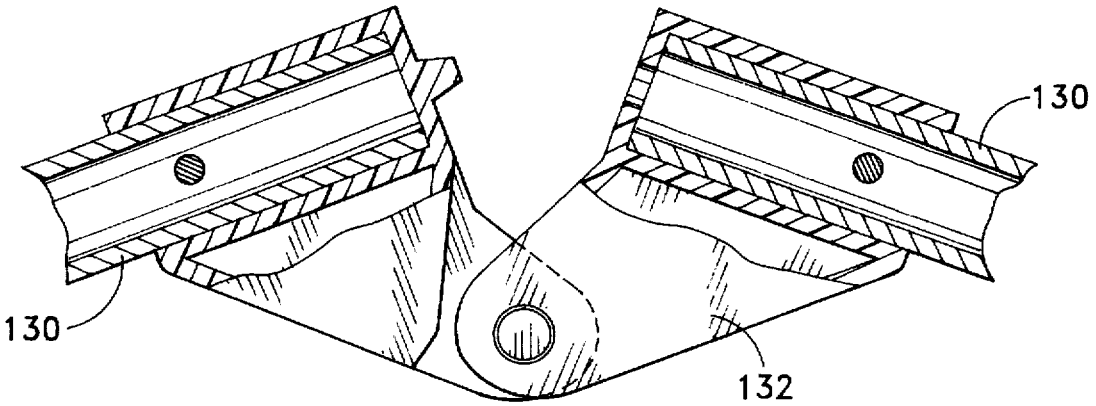
FIG. 20A is a similar sectional view with the knuckle joint of the second frame subassembly in a partially pivoted position.
Figure 21:
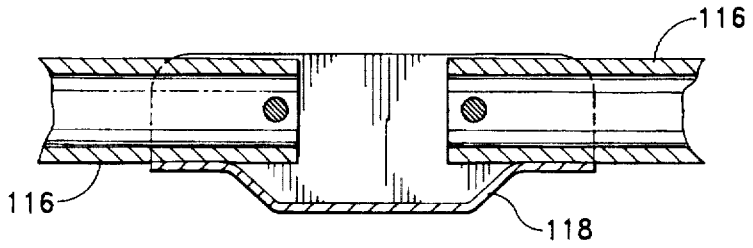
FIG. 21 is a sectional view taken along line 21—21 in FIG. 18.
Figure 21A:
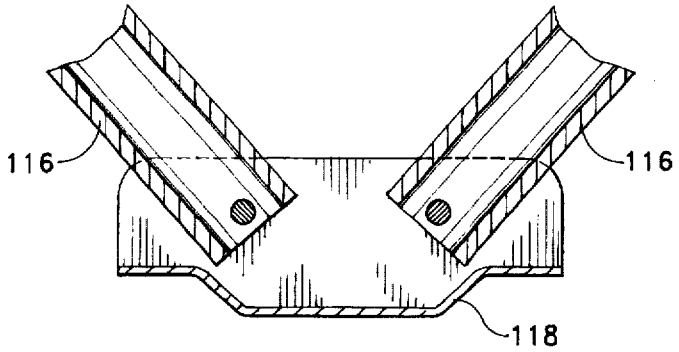
FIG. 21A is a similar sectional view with the knuckle joint of the first frame subassembly in a partially pivoted position.
Figure 22:
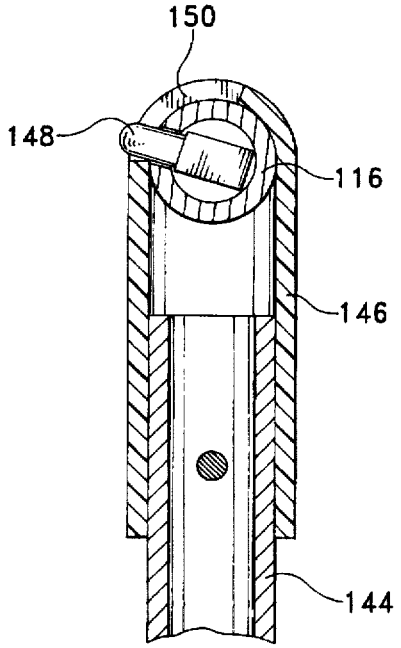
FIG. 22 is a sectional view taken along line 22—22 in FIG. 18.
Figure 22A:
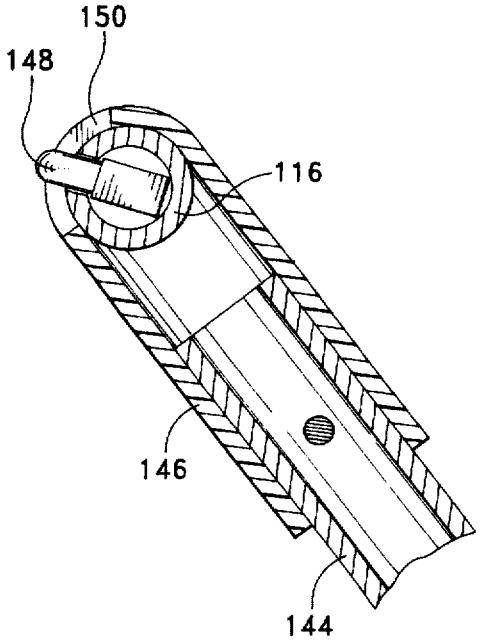
FIG. 22A is a similar sectional view with the connector member in a partially collapsed position.
Figure 26:
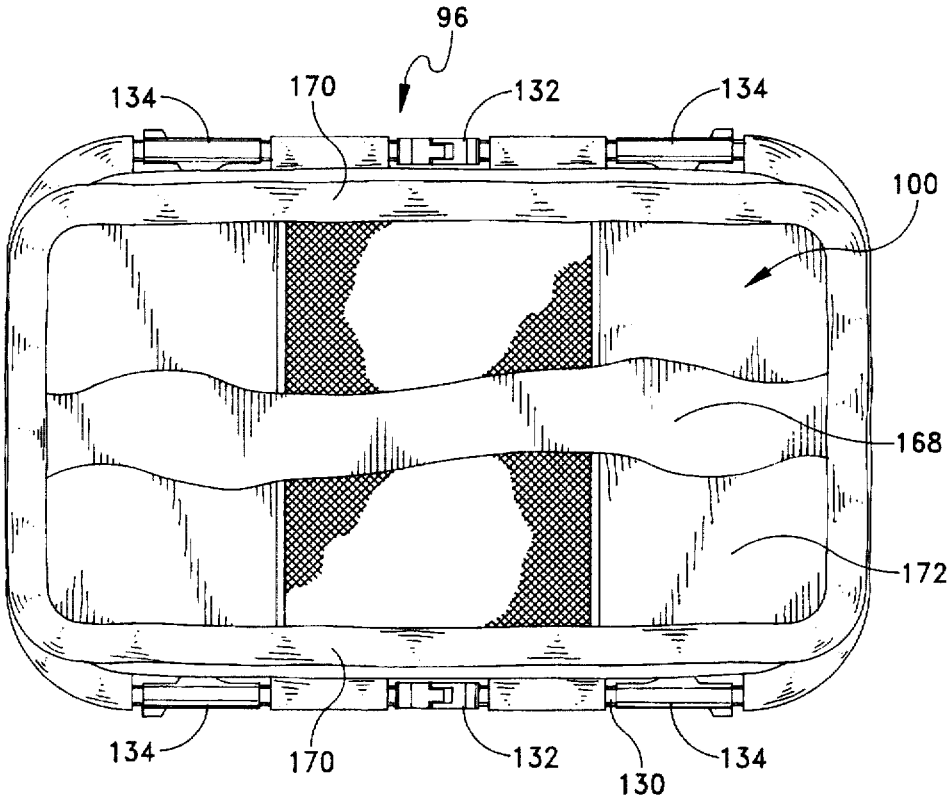
Figure 27:
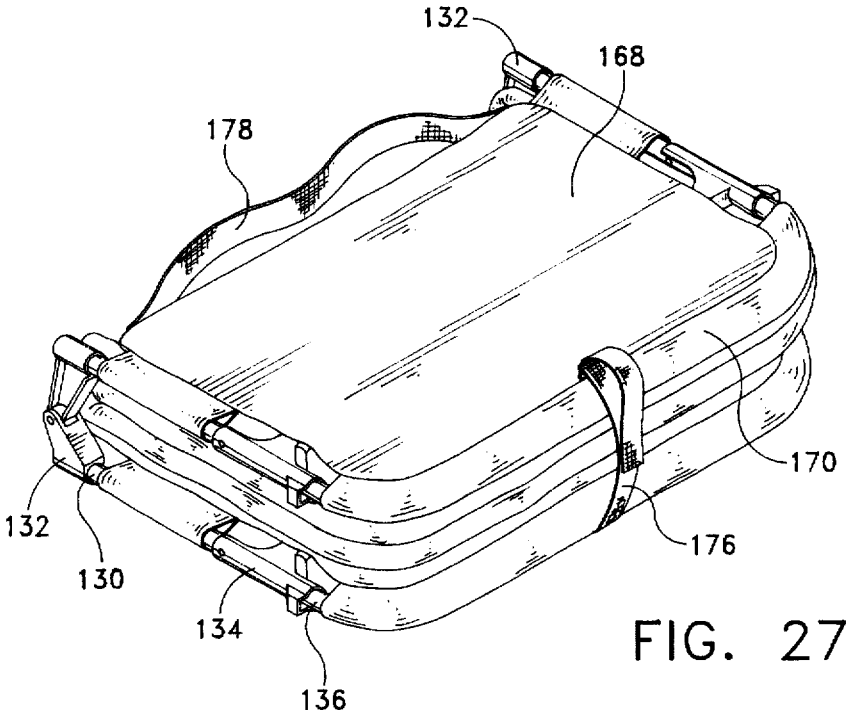

The second frame subassembly 104 comprises first, second, third and fourth connected frame members 120, 122, 124 and 126 which are correspondingly oriented relative to the first, second, third and fourth frame member sections 108, 110, 112, and 114 of the first frame subassembly 102. The first and third frame member sections 120 and 124, however, are integrally joined to their adjacent collapsible connecting members 106 at bends 128. The first and third frame members 120 and 124 each include a pair of frame member sections 130 which are integrally joined with a knuckle joint 132. In this regard, however, as illustrated in FIG. 18, in contrast to the knuckle joints 118, the knuckle joints 132 are adapted so that they are only pivotable in the plane defined by the bottom or second frame subassembly 104 when the frame assembly 98 is in an erected position. Accordingly, the knuckle joints 132 are adapted to pivot in a plane which is angularly oriented by approximately 90 degrees relative to the planes in which the knuckle joints 118 are adapted to pivot when the frame assembly 98 is in an erected position. As a result, when the frame assembly 98 is in an erected position, the knuckle joints 118 and 132 cooperate to enhance the rigidity thereof. The first and third frame members 120 and 124 further include joints 134 which are rigidly attached to the bends 128, but rotatably attached to end sections 136 of the frame members 120 and 124. As a result, the frame member sections 130 and the knuckle joints 132 are rotatable to reorient the knuckle joints 132 by approximately 90 degrees when the collapsible connecting members 106 are collapsed as will hereinafter be more fully set forth. The joints 134 include outwardly biased pins 138 which are received in apertures in the end sections 136 and slots 140 in the joints 134 to rotatably secure the joints 134 to the end sections 136. The end sections 136 are integrally joined to their respective adjacent second or fourth frame members 122 or 126, respectively, as illustrated in FIG. 18. Further, the second and fourth frame members 122 and 126, respectively, are slightly longer than the second and fourth frame members 110 and 114 of the first frame subassembly 102 to allow the first frame subassembly to be received in at least partially nested relation in the second frame subassembly as illustrated in FIG. 26.

The collapsible connecting members 106 each include lower and upper connecting member sections 142 and 144, respectively, which are joined with a knuckle joint 146. The lower connecting member sections 142 are integrally joined to the adjacent first or third frame member sections 120 or 124, respectively, through the bends 128, and the upper sections 144 are attached to the first or third frame members 108 or 112, respectively, of the upper frame subassembly 102 with connector joints 146. The connector joints 146 are of T-shaped configuration, and they are rigidly received on the upper ends of the upper connector element sections 144 and rotatably received on the frame member sections 116. Further, the connector joints 146 include spring biased pins 148 which pass through apertures in their respective frame member sections 116 and through slots 150 in the connector joints 146. As a result, the connector joints 146 are longitudinally retained in position on their respective frame member sections 116, but they are nevertheless rotatable by approximately 90 degrees relative thereto. Accordingly, when the connector members 106 are collapsed inwardly, the knuckle joints 118 remain in their original unrotated conditions, whereas the knuckle joints 132 are rotationally reoriented by approximately 90 degrees so that they are pivotable in the same direction as the knuckle joints 118 once the connecting members 106 have been fully collapsed.

Figure 23:
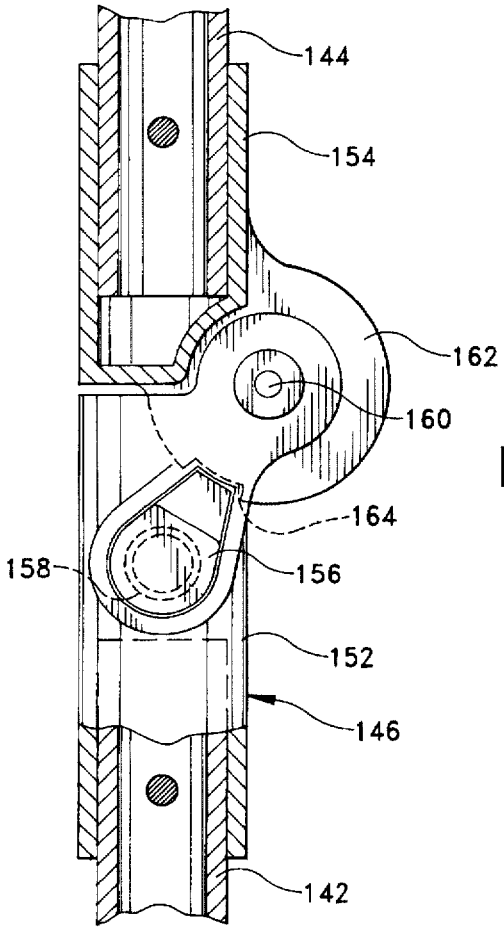
FIG. 23 is a sectional view taken along line 23—23 in FIG. 18.
Figure 23A:
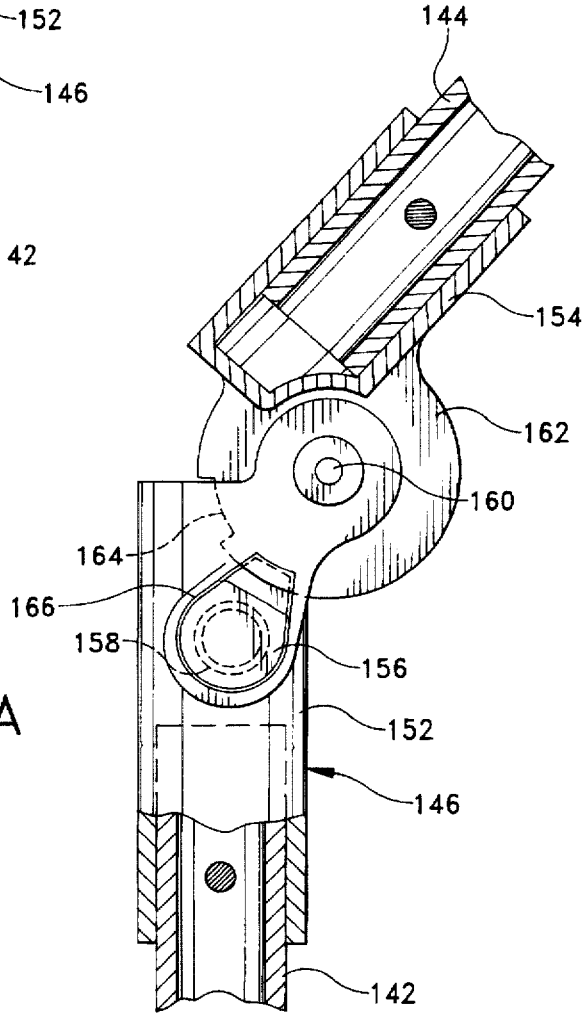
FIG. 23A is a similar sectional view with the connector element in a partially collapsed position.
Figure 24:
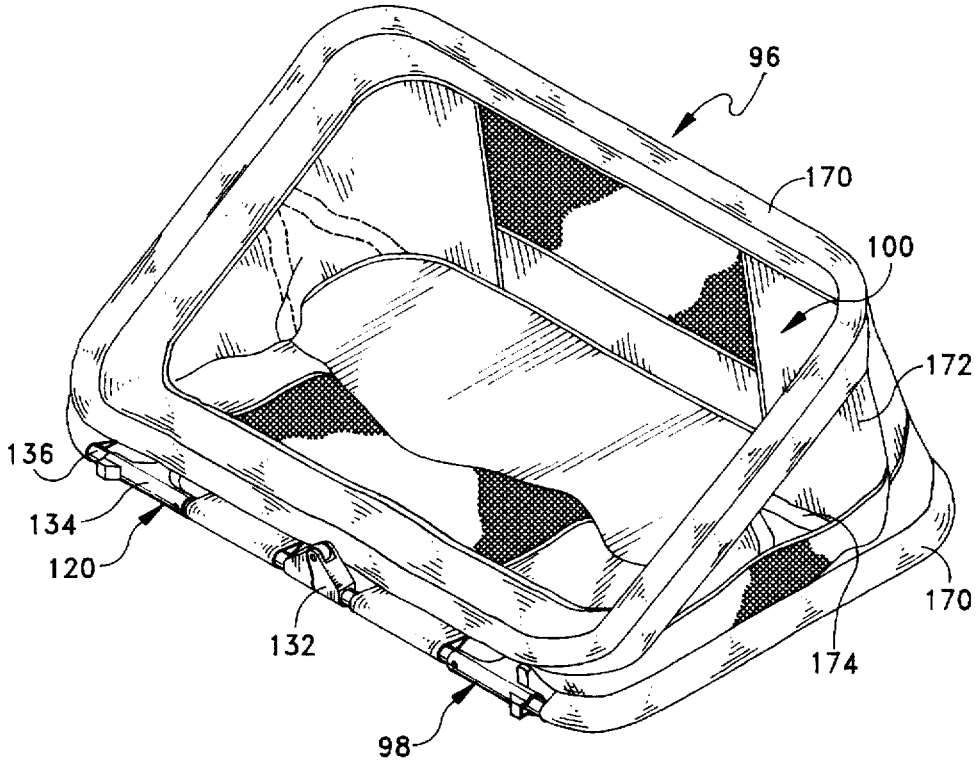
FIGS. 24–27 are sequential perspective views of a playyard comprising the subassembly of the second embodiment of the instant invention as it is moved from a partially collapsed position to a fully collapsed position.
Figure 25:
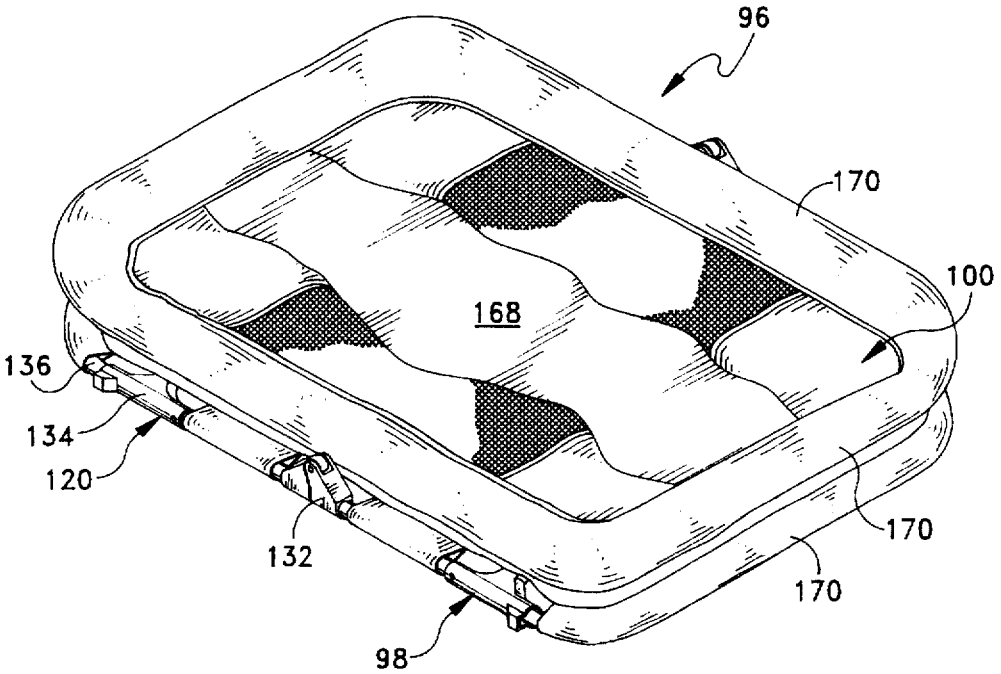

The knuckle joints 146 are illustrated most clearly in FIGS. 23 and 23A. Each of the knuckle joints 146 includes a lower section 152, an upper section 154, a latch 156, and a spring 158. The lower and upper sections 152 and 154 of each knuckle joint 146, respectively, are pivotable about a pin 160, and the upper section 154 of each knuckle joint includes a hub portion 162 having a peripheral notch 164 therein. The lower portion 152 of each knuckle joint 146 has a latch cavity 166 therein, and a latch button 156 and a spring 158 are received in each cavity 166. Further, the cavity 166, the latch button 156, and the notch 164 of each knuckle joint are oriented and configured so that the latch button 156 thereof is receivable in the notch 164 thereof for retaining the respective upper and lower sections 154 and 152, respectively, in aligned relation. However, by pressing the latch button 156 of a knuckle joint 146 inwardly against the force of the spring 158 thereof, the latch button 156 can be removed from the notch 164 to permit the upper and lower sections 154 and 152, respectively, to be pivoted in the manner illustrated in FIG. 23A. Accordingly, the knuckle joints 146 are releasably securable in erected positions in which the upper and lower sections 154 and 152, respectively, are in substantially aligned relation. However, the knuckle joints 146 are collapsible by releasing the latch buttons 156 thereof and pivoting the upper and lower sections 154 and 152, respectively, thereof inwardly.

The fabric covering 100 comprises a reinforced floor section 168, a plurality of tubular fabric sections 170 which are received over various elements of the frame assembly 102, and a plurality of fabric wall sections 172 which are partially made from an open mesh material to allow a child to look outwardly from the interior of the playyard 96. The fabric covering 100 further includes a plurality of reinforcing straps 174 which enhance the overall rigidity of the playyard 96 when it is in an erected position by preventing the upper frame subassembly 102 from collapsing at the knuckle joints 118. Also included in the covering 100 is a retaining strap 176, for retaining the playyard 96 in the collapsed position, and a shoulder strap 178.

It is seen, therefore, that the playyard 96 provides an effective yet relatively simple playyard which can be easily collapsed into a compact, readily transportable structure.

The connecting members 106 are collapsible inwardly to allow the upper frame subassembly 102 to be folded downwardly, and because the width of the upper frame subassembly 102 is slightly smaller than the width of the lower frame subassembly 104, the upper frame subassembly can be received in an at least partially nested relation in the lower frame subassembly 104. Further, because the upper frame subassembly 102 is receivable in an at least partially nested relation in the lower frame subassembly 104, the upper or first frame subassembly 102 and the lower or second frame subassembly 106 can be folded over together to the position illustrated in FIG. 27 without the upper frame subassembly 102 interfering with the operation of the knuckle joints 132. Accordingly, the playyard 96 can be readily and easily collapsed by manipulating the knuckle joints 146 and then simply folding the frame subassemblies 102 and 104 in half to position the playyard 96 in the fully collapsed position illustrated in FIG. 27.

While there is shown an described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A collapsible frame assembly for a playyard for an infant comprising first and second frame subassemblies and collapsible connecting means for collapsibly connecting said first and second subassemblies in an erected position in which said first and second subassemblies are maintained in spaced substantially parallel relation, each of said frame subassemblies including connected correspondingly positioned first, second, third and fourth frame members which cooperate to define a generally rectangular collapsible frame structure having a fixed width as defined by the second and fourth frame members thereof, each of said first and third frame members being hingeably collapsible on itself for collapsing said playyard to a compact configuration, the width of said first frame subassembly being sufficiently smaller than the width of said second frame subassembly to permit said first frame subassembly to be at least partially nested within said second frame subassembly for collapsing said playyard into said compact configuration, said collapsible connecting means being collapsible in such a manner as to allow said first frame subassembly to be at least partially nested within said second frame subassembly when said playyard is collapsed into said compact configuration.

2. A collapsible frame assembly for a playyard for an infant comprising first and second frame subassemblies and collapsible connecting means for collapsibly connecting said first and second subassemblies in an erected position in which said first and second subassemblies are maintained in spaced substantially parallel relation, each of said frame subassemblies including connected correspondingly positioned first, second, third and fourth frame members which cooperate to define a generally rectangular frame structure having a width, the width of said first frame subassembly being sufficiently smaller than the width of said second frame subassembly to permit said first frame subassembly to be at least partially nested within said second frame subassembly for collapsing said playyard into a compact configuration, the first and third members of each subassembly defining the respective width thereof and each including a pair of frame member sections which are pivotally joined with a knuckle joint, each of said knuckle joints only being pivotable in a single direction from an erected position in which the respective frame member sections thereof are in aligned relation, the knuckle joints in each frame subassembly being oriented such that when said frame assembly is in an erected position, the knuckle joints in the same subassembly are only pivotable in the same or parallel planes and the knuckle joints in different subassemblies are pivotable in planes which are at angles of approximately 90 degrees, said collapsible connecting means rotating the knuckle joints of one of said frame subassemblies so that the knuckle joints of both subassemblies are only pivotable in the same or parallel planes and positioning said frame subassemblies in at least partially nested relation as said connection means is collapsed so as to permit said first and second frame subassemblies to be simultaneously folded in the same direction about the knuckle joints thereof for further collapsing said first and second subassemblies as a unit.

3. In the collapsible frame assembly of claim 1, said first and second frame subassemblies defining top and bosom sections of said frame assembly, respectively.

4. A collapsible frame assembly for a playyard for an infant comprising first and second frame subassemblies and collapsible connecting means for collapsibly connecting said first and second subassemblies in an erected position in which said first and second subassemblies are maintained in spaced substantially parallel relation, each of said frame subassemblies including connected correspondingly positioned first, second, third and fourth frame members which cooperate to define a generally rectangular frame structure having a width, the width of said first frame subassembly being sufficiently smaller than the width of said second frame subassembly to permit said first frame subassembly to be at least partially nested within said second frame subassembly for collapsing said playyard into a compact configuration, the first and third frame members of each of said first and second frame subassemblies each including a pair of frame member sections which are joined by a knuckle joint, each of said knuckle joints being hingeable in a single direction, the knuckle joints of said first and second frame subassemblies all being hingeable in the same direction for folding said frame assembly when said first frame subassembly is received in at least partially nested relation in said second frame subassembly.

5. In the collapsible frame assembly of claim 4, the knuckle joints of said first frame subassembly and the knuckle joints of said second frame subassembly only being pivotable in directions which are approximately 90 degrees apart to resist collapsing when said frame assembly is in an erected position.

6. In the collapsible frame assembly of claim 5, said collapsible connecting means rotating the knuckle joints of one of said frame subassemblies to positions in which they are only hingeable in the same direction as the knuckle joints of the other one of said frame subassemblies.

7. In the collapsible frame assembly of claim 6, said first frame subassembly defining a top frame subassembly of said frame assembly, said second frame subassembly defining a bottom frame subassembly of said frame assembly.

8. In the frame assembly of claim 7, said first frame subassembly being receivable in nested relation in said second frame subassembly.

9. A collapsible frame assembly for a playyard for an infant comprising first and second frame subassemblies and collapsible connecting means for collapsibly connecting aid first and second subassemblies in an erected position in which said first and second subassemblies are maintained in spaced substantially parallel relation, each of said frame subassemblies including connected correspondingly positioned first, second, third and fourth frame members which cooperate to define a generally rectangular frame structure having a width, the width of said first frame subassembly being sufficiently smaller than the width of said second frame subassembly to permit said first frame subassembly to be at least partially nested within said second frame subassembly for collapsing said playyard into a compact configuration, said first and second frame subassemblies defining top and bottom sections of said frame assembly, respectively, the first and third frame members of said first and second frame subassemblies each including a pair of frame member sections which are joined by a knuckle joint, said first and second frame subassemblies being simultaneously foldable about the knuckle joints thereof when said frame subassemblies are in at least partially nested relation for collapsing said first and second subassemblies.

* * * * *